US006537392B2

(12) United States Patent
Magnusen et al.

(10) Patent No.: US 6,537,392 B2
(45) Date of Patent: Mar. 25, 2003

(54) CORROSION RESISTANT 6000 SERIES ALLOY SUITABLE FOR AEROSPACE APPLICATIONS

(75) Inventors: Paul E. Magnusen, Pittsburgh, PA (US); Edward L. Colvin, West Lafayette, IN (US); Roberto J. Rioja, Murrysville, PA (US)

(73) Assignee: Alcoa Inc., Pittsburgh, PA (US)

( * ) Notice: Subject to any disclaimer, the term of this patent is extended or adjusted under 35 U.S.C. 154(b) by 6 days.

(21) Appl. No.: 09/873,031

(22) Filed: Jun. 1, 2001

(65) Prior Publication Data

US 2002/0039664 A1 Apr. 4, 2002

Related U.S. Application Data

(60) Provisional application No. 60/208,712, filed on Jun. 1, 2000.

(51) Int. Cl.[7] ..... C22C 21/08
(52) U.S. Cl. ..... 148/417; 420/532; 420/534
(58) Field of Search ..... 148/417; 420/532, 420/534; C22C 21/08

(56) References Cited

U.S. PATENT DOCUMENTS

| | | | | |
|---|---|---|---|---|
| 4,589,932 A | 5/1986 | Park | ..... | 148/12.7 A |
| 5,858,134 A | 1/1999 | Bechet et al. | ..... | 148/550 |

FOREIGN PATENT DOCUMENTS

| | | | | |
|---|---|---|---|---|
| JP | 60-82643 | 10/1983 | ..... | C22C/21/06 |
| JP | 10-176233 A * | 6/1998 | | |
| WO | 96/12829 | 5/1996 | ..... | C22F/1/05 |
| WO | 96/35819 | 11/1996 | ..... | C22F/1/04 |

OTHER PUBLICATIONS

"TTP and TTT Diagrams for Quench Sensitivity of 6013 Alloy", Aluminum Alloys, vol. 2, Davydov et al., pp. 603–608.
"Development of High Strength Al–Mg–Si–Cu Alloy with Corrosion Resistance", Materials Science Forum, vols. 217–222 (1996), Uchida et al., pp. 1753–1758.
"The Effect of Zinc Additions on the Corrosion Properties of Aluminum–Magnesium Alloys", Aluminium Alloys, vol. 3, Dif et al., pp. 1489–1494.
"6056 T78: A Corrosion Resistant Copper–Rich 6XXX Alloy for Aerospace Applications", Aluminum Alloys, vol. 3, Dif et al., pp. 1991–1996.
"Corrosion Behaviour of 2024 T351 and 6056 T6 Aluminium Alloys in Chloride Solution", Aluminum Alloys, vol. 3, Guillaumin et al., pp. 1663–1668.

(List continued on next page.)

*Primary Examiner*—George Wyszomierski
*Assistant Examiner*—Janelle Combs Morillo
(74) *Attorney, Agent, or Firm*—Gary P. Topolosky

(57) ABSTRACT

There is claimed an aerospace alloy having improved corrosion resistance performance, particularly intergranular corrosion resistance. The alloy consisting essentially of: about 0.6–1.15 wt. % silicon, about 0.6–1.0 wt. % copper, about 0.8–1.2 wt. % magnesium, about 0.55–0.86 wt. % zinc, less than about 0.1 wt. % manganese, about 0.2–0.3 wt. % chromium, the balance aluminum, incidental elements and impurities. While it is preferably made into sheet or plate product forms, it can also be extruded. Products made from this alloy exhibit at least about 5% greater yield strength and about 45% or greater resistance to intergranular corrosion attack than their 6013-T6 counterparts, as measured by average depth of corrosion after 24 hours exposure to an aqueous NaCl—$H_2O_2$ solution per ASTM Standard G110 (1992).

30 Claims, 1 Drawing Sheet

OTHER PUBLICATIONS

"Some Aspects of Precipitation Hardening in Aluminum Alloy 6056 T6—T.E.M. Experiments", Materials Science Forum, vols. 217–222, 1996, pp. 1305–1310, 1996 Transtec Publications, Vivas et al.

"Susceptibility to Pitting Corrosion of Pure Aluminium, 2024 Alloy and 6056 Alloy in Chloride Containing Sulphate Solutions", Materials Science Forum vols. 217–222 (1996), pp. 1559–1564, Blanc et al.

"On the Strengthening of Aluminium Alloy 6056T6", Aluminum Alloys, vol. 2, Vivas et al., pp. 943–948.

"Transmission Electron Microscopy Study of Precipitate Morphology and Precipitate Overcoming Processes in Aluminum Alloy 6056 T6", Materials Science and Engineering A234–236 (1997) pp. 664–667, Vivas et al.

"Understanding and Modelling the Mechanical and Corrosion Properties of 6056 for Aerospace Applications", Materials Science Forum, vol. 331–337 (2000), pp. 1613–1618, Dif et al.

"Microscopic Investigation of the Intergranular Corrosion of Alloy 6013–T6", The 3$^{rd}$ International Conference on Aluminum Alloys, T. D. Burleigh, Jun. 1992.

* cited by examiner

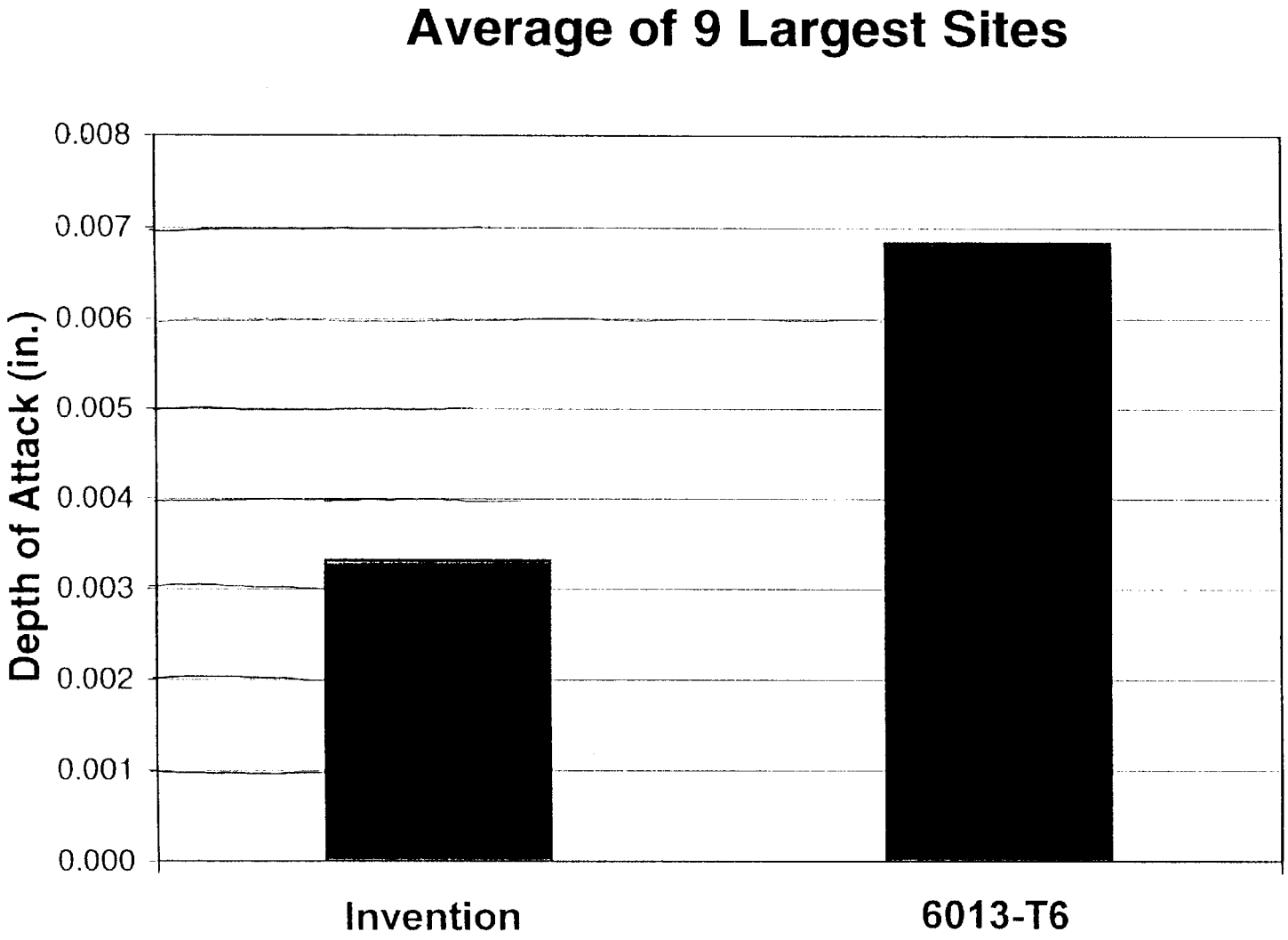
FIGURE

CORROSION RESISTANT 6000 SERIES ALLOY SUITABLE FOR AEROSPACE APPLICATIONS

CROSS REFERENCE TO RELATED APPLICATIONS

This application claims the benefit of U.S. Provisional Application Serial No. 60/208,712, filed on Jun. 1, 2000, the disclosure of which is fully incorporated by reference herein.

FIELD OF THE INVENTION

This invention pertains to aluminum aerospace alloys. More particularly, this invention pertains to aluminum alloys that are suitable for welding, yet have improved performance properties, particularly corrosion resistance.

BACKGROUND OF THE INVENTION

Airplane manufacturers are investigating the possibility of welding fuselage skin panels together as a low cost alternative to fastening them with rivets, welding generally being defined as having good retention of mechanical properties after the joining together of two or more parts, either by mechanical welding, laser welding, other welding techniques, or a combination of practices. Existing alloys that are currently used for fuselage skins include Aluminum Alloys 2024 and 2524, Aluminum Association registrations. Certain properties of these alloys are adversely affected by welding, however. Alloy 6013 has attractive mechanical properties for use as a fuselage skin alloy and is also weldable. But alloy 6013 is susceptible to intergranular corrosion attack which can increase local stress concentrations when the aircraft into which 6013 is installed gets subjected to stress conditions such as repeated pressurization/depressurization of a plane's fuselage flight after flight. Cyclic, or repetitive, loading can lead to the formation of fatigue cracks at these sites in less time than would be expected for an uncorroded structure. In order to take full advantage of the cost savings offered by fuselage skin panel welding, therefore, it would be desirable to develop a weldable aluminum aerospace alloy that has improved resistance to intergranular corrosion attack.

Other patents or international applications are applicable to this alloy system and product application. Comparative alloy compositions are listed in Table 1 that follows.

TABLE 1

| | Relative Alloy Compositions | | | | | | | |
|---|---|---|---|---|---|---|---|---|
| Alloying | WO 96/12829 Alloy 6056 | | WO 96/35819 | | U.S. Pat. No. 4,589,932 Alloy 6013 | | Invention min.-max | |
| Element | min. | max | min. | max. | min. | max | More Preferably | |
| Si | 0.70 | 1.30 | 0.60 | 1.40 | 0.40 | 1.20 | 0.6 | 1.15 |
| | | | | | | | 0.7 | 1.03 |
| Cu | 0.50 | 1.10 | | 0.60 | 0.60 | 1.10 | 0.60 | 1.00 |
| | | | | | | | 0.70 | 0.90 |
| Mg | 0.60 | 1.10 | 0.60 | 1.40 | 0.50 | 1.30 | 0.80 | 1.20 |
| | | | | | | | 0.85 | 1.05 |
| Zn | 0.00 | 1.00 | 0.40 | 1.40 | | | 0.55 | 0.86 |
| | | | | | | | 0.60 | 0.80 |
| Mn | 0.30 | 0.80 | 0.20 | 0.80 | 0.10 | 1.00 | | 0.09 |
| | | | | | | | | 0.04 |
| Cr. | | 0.25 | 0.05 | 0.30 | | | 0.20 | 0.30 |
| | | | | | | | 0.21 | 0.29 |
| Fe | | 0.30 | | 0.50 | | | | 0.20 |
| | | | | | | | | 0.15 |
| Zr | | 0.20 | | | | | | 0.10 |
| | | | | | | | | 0.04 |
| Ag | | 1.00 | | | | | | 0.10 |
| | | | | | | | | 0.04 |

SUMMARY OF THE INVENTION

A principal objective of the present invention is to provide an improved 6000 series alloy that is weldable, yet exhibits improved corrosion resistance properties. It is another principal objective to provide an improved aluminum aerospace alloy suitable for forming: into sheet and plate products primarily, into various extruded product forms secondarily, and less preferentially into forged product shapes using known or subsequently developed product manufacturing processes.

These and other objectives are met or exceeded by the present invention, one embodiment of which pertains to an aluminum alloy suitable for welding. That alloy consists essentially of: about 0.6–1.15 wt. % silicon, about 0.6–1.0 wt. % copper, about 0.8–1.2 wt. % magnesium, about 0.55–0.86 wt. % zinc, less than about 0.1 wt. % manganese, about 0.2–0.3 wt. % chromium, up to about 0.2 wt. % iron, up to about 0.1 wt. % zirconium and up to about 0.1 wt. % silver, the balance aluminum, incidental elements and impurities. On a more preferred basis, this alloy contains 0.7–1.03 wt. % silicon, about 0.7–0.9 wt. % copper, about 0.85–1.05 wt. % magnesium, about 0.6–0.8 wt. % zinc, about 0.04 wt. % or less manganese, about 0.21–0.29 wt. % chromium, about 0.15 wt. % or less iron, about 0.04 wt. % or less zirconium and about 0.04 wt. % or less silver, the balance aluminum, incidental elements and impurities. Originally, it was believed that silicon minimums of about 0.75 wt. % would suffice. Subsequent samplings have revealed, however, that silicon levels as low as 0.6 wt. % should also work in conjunction with this invention. it is believed that the addition of chromium and significant reduction of manganese in this composition are pertinent to the results achieved.

The invention consists of an aluminum alloy having a composition as listed in the above table. This alloy offers increased typical tensile strength compared to existing alloys when aged to a peak temper or T6 condition. For comparative purposes, the relative T6 typical strengths and % elongations for various alloys are listed in Table 2 below. Minimum or guaranteed strength values cannot be compared versus 6013 values as not enough statistical values exist for fairly determining such minimum or guaranteed strength values for the invention alloy herein.

TABLE 2

Comparative Typical Strengths and % Elongation

| Alloy | Condition | YS (ksi) | TS (ksi) | % elong |
|---|---|---|---|---|
| Invention | T6 | 55.3 | 60.2 | 11.7 |
| Invention | Under Aged | 53.5 | 59.8 | 14.2 |
| 6013 | T6 | 51.1 | 56.1 | 13.2 |
| 6056 | T6 | 51.5 | 56.1 | 10.5 |
| WO96/35819 | T6 | 53.2 | 56.5 | 9 |

In the peak aged condition, the alloy of this invention offers greater resistance to intergranular corrosion resistance compared to its 6013 aluminum alloy counterpart. Further increases in intergranular corrosion resistance can be obtained by underaging, i.e. purposefully limiting artificial aging times and temperatures so that the metal alloy product does not reach peak strength.

BRIEF DESCRIPTION OF THE DRAWING

The lone accompanying FIGURE is a graphic depiction of the improvement observed for this invention, as compared to a commonly tempered 6013 specimen, after both parts were subjected to intergranular corrosion testing per ASTM Standard G110 (1992).

DETAILED DESCRIPTION OF PREFERRED EMBODIMENTS

For any description of preferred alloy compositions, all references to percentages are by weight percent (wt. %) unless otherwise indicated. When referring to any numerical range of values, such ranges are understood to include each and every number and/or fraction between the stated range minimum and maximum. A range of about 0.6–1.15 wt. % silicon, for example, would expressly include all intermediate values of about 0.61, 0.62, 0.63 and 0.65% all the way up to and including 1.12, 1.13 and 1.14% Si. The same rule applies to every other elemental range and/or property value set forth hereinbelow.

Typically, it has been seen that improvements in intergranular corrosion resistance have been achieved with corresponding decreases in strength. However, in the new alloy improvements in both strength and corrosion resistance were achieved. It was not expected that underaging would provide an additional advantage in corrosion resistance. Yet, just that phenomenon was observed. Past experience has shown that corrosion resistance of heat treatable aluminum alloys, particularly resistance to intergranular corrosion, improves by overaging, (i.e. artificially aging by a practice that causes the metal to go past peak strength to a lower strength condition). This is one method that has been employed to increase the intergranular corrosion resistance of 6056 aluminum but with significant decreases in strength compared to peak aged tempers. With respect to the present invention, it has been observed that the strength values for these new alloys, in an underaged temper, are actually greater than comparable strength values for a comparable, overaged 6056 aluminum part.

Reduced intergranular corrosion attack is particularly useful for applications that expose the metal to corrosive environments, such as the lower portion of an aircraft fuselage. Moisture and corrosive chemical species tend to accumulate in these areas of an aircraft as solutions drain to the bottom of the fuselage compartment. It would be desirable to have an alloy here that is suitable for welding, yet requires high strength. For comparison purposes, specimens of the invention alloy and those of 6013 aluminum, both aged for about 8 hours at about 350° F. to produce a T6 temper, were subjected to corrosion testing per ASTM Standard G110 (1992), the disclosure of which is fully incorporated by reference herein. Per that ASTM Standard, clad specimens of both metals had their cladding layers removed prior to being exposed for 24 hours to an aqueous NaCl—$H_2O_2$ solution. Using metallography on a polished cross-section of the corroded samples, the nine largest sites on each specimen were then measured for determining the type and their average depth of intergranular corrosion attack. These averages compared as follows: average depth of attack for the Invention alloy: 0.0033 in. versus the average attack depth of 0.006833 measured for 6013-T6, or greater than twice the intergranular corrosion attack average depth of the present invention. These values are graphically depicted in the accompanying FIGURE.

It is important to note that the alloy composition of this invention works well at resisting intergranular corrosion in both its clad and unclad varieties. For some clad versions, the alloy layer applied overtop the invention alloy is a 7000 Series alloy cladding, more preferably 7072 aluminum (Aluminum Association designation), as opposed to the more commonly known cladding of 1145 aluminum.

Aerospace applications of this invention may combine numerous alloy product forms, including, but not limited to, laser and/or mechanically welding: sheet to a sheet or plate base product; plate to a sheet or plate base product; or one or more extrusions to such sheet or plate base products. One particular embodiment envisions replacing the manufacture of today's airplane fuselage parts from large sections of material from which significant portions are machined away. Using the alloy composition set forth above, panels can be machined or chemically milled to remove metal and reduce thickness at selective strip areas to leave upstanding ribs between the machined or chemically milled areas. These upstanding ribs provide good sites for welding stringers thereto for reinforcement purposes. Such stringers can be made of the same or similar composition, or of another 6000 Series (or "6XXX") alloy composition (Aluminum Association designation), so long as the combined components still exhibit good resistance to intergranular corrosion attack.

For the comparative data reported in above Table 2, two 14" by 74" ingots were cast from the invention alloy and a comparative 6013 composition. The invention alloy was then clad on both sides with thin layers of 7072 aluminum (Aluminum Association designation); the 6013 alloy was clad on both sides with thin liner layers of 1145 aluminum (Aluminum Association designation). Both dual clad materials were then rolled to a 0.177 inch finish gauge after which two tempers of each material were produced: (1) a T6-type temper (by aging for about 8 hours at about 350° F.); and (2) a T6E "underaged" temper (by subjecting material to heating for about 10 hours at about 325° F.) The respective samples were then subjected to various material evaluations, focusing on strength and corrosion resistance primarily.

Having described the presently preferred embodiments, it is to be understood that the invention may be otherwise embodied within the scope of the appended claims.

What is claimed is:

1. An aerospace alloy having improved corrosion resistance performance, said alloy consisting essentially of: about 0.6–1.15 wt. % silicon, about 0.6–1.0 wt. % copper, about 0.8–1.2 wt. % magnesium, about 0.55–0.86 wt. % zinc, less than about 0.1 wt. % manganese, about 0.2–0.3 wt. % chromium, the balance aluminum, incidental elements and impurities.

2. The alloy of claim 1 which further includes up to about 0.2 wt. % iron, up to about 0.1 wt. % zirconium and up to about 0.1 wt. % silver.

3. The alloy of claim 1 wherein said corrosion resistance includes intergranular corrosion resistance.

4. The alloy of claim 1 which is processed into clad or unclad, sheet or plate product.

5. The alloy of claim 4 wherein said sheet or plate product is clad with 7072 aluminum.

6. The alloy of claim 1 which is an extrusion.

7. The alloy of claim 1 which has been tempered to a T6-type condition.

8. The alloy of claim 7 which has a typical yield strength of at least about 54 ksi.

9. The alloy of claim 1 which has been purposefully underaged.

10. The alloy of claim 1 which is an airplane fuselage part selected from the group consisting of fuselage skin, extruded stringers and combinations thereof welded together by laser and/or mechanical welding.

11. The alloy of claim 1 which contains about 0.7–1.03 wt. % silicon.

12. The alloy of claim 1 which contains about 0.7–0.9 wt. % copper.

13. The alloy of claim 1 which contains about 0.85–1.05 wt. % magnesium.

14. The alloy of claim 1 which contains about 0.6–0.8 wt. % zinc.

15. The alloy of claim 1 which contains about 0.04 wt. % or less manganese.

16. The alloy of claim 1 which contains about 0.21–0.29 wt. % chromium, about 0. 15 wt. % or less iron, about 0.04 wt. % or less zirconium and about 0.04 wt. % or less silver.

17. A weldable aerospace sheet or plate product having improved resistance to intergranular corrosion, said product consisting essentially of: about 0.6–1.15 wt. % silicon, about 0.6–1.0 wt. % copper, about 0.8–1.2 wt. % magnesium, about 0.55–0.86 wt. % zinc, less than about 0.1 wt. % manganese, about 0.2–0.3 wt. % chromium, the balance aluminum, incidental elements and impurities.

18. The product of claim 17 which has been tempered to a T6-type condition.

19. The product of claim 18 which has yield strength of at least about 54 ksi.

20. The product of claim 17 which has been purposefully underaged.

21. The product of claim 17 which is a clad or unclad airplane fuselage part.

22. The product of claim 21 which has been clad with 7072 aluminum.

23. The product of claim 17 which contains about 0.7–1.03 wt. % silicon; about 0.7–0.9 wt. % copper, about 0.85–1.05 wt. % magnesium, and about 0.6–0.8 wt. % zinc.

24. The product of claim 17 which contains about 0.04 wt. % or less manganese.

25. A weldable, aerospace extrusion having improved resistance to intergranular corrosion, said extrusion consisting essentially of: about 0.6–1.15 wt. % silicon, about 0.6–1.0 wt. % copper, about 0.8–1.2 wt. % magnesium, about 0.55–0.86 wt. % zinc, less than about 0.1 wt. % manganese, about 0.2–0.3 wt. % chromium, the balance aluminum, incidental elements and impurities.

26. The extrusion of claim 25 which has been tempered to a T6-type condition.

27. The product of claim 26 which has a yield strength of at least about 54 ksi.

28. The extrusion of claim 25 which has been purposefully underaged.

29. The extrusion of claim 25 which contains about 0.7–1.03 wt. % silicon; about 0.7–0.9 wt. % copper, about 0.85–1.05 wt. % magnesium, and about 0.6–0.8 wt. % zinc.

30. The extrusion of claim 25 which contains about 0.04 wt. % or less manganese.

* * * * *